US006449538B1

(12) United States Patent
Kubo et al.

(10) Patent No.: US 6,449,538 B1
(45) Date of Patent: Sep. 10, 2002

(54) ENGINE OIL DEGRADATION DETECTOR

(75) Inventors: Hiroshi Kubo; Hiroshi Hashimoto, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/084,927

(22) Filed: Mar. 1, 2002

(30) Foreign Application Priority Data

Mar. 19, 2001 (JP) ..... 2001-077597

(51) Int. Cl.[7] ..... F01M 11/00
(52) U.S. Cl. ..... 701/30; 701/35; 73/117.3
(58) Field of Search ..... 701/30, 35, 29, 701/1; 73/117.2, 117.3, 118.1; 340/438

(56) References Cited

U.S. PATENT DOCUMENTS 4,742,476 A 5/1988 Schwartz et al.
4,847,768 A * 7/1989 Schwartz et al. ..... 701/30
5,633,796 A * 5/1997 Cullen et al. ..... 701/30
5,750,887 A * 5/1998 Schricker ..... 73/117.3
6,339,742 B2 * 1/2002 Weisman, II ..... 701/35

FOREIGN PATENT DOCUMENTS

JP 62-203915 9/1987

* cited by examiner

*Primary Examiner*—Richard M. Camby
(74) *Attorney, Agent, or Firm*—Arent Fox Kintner Plotkin & Kahn, PLLC

(57) ABSTRACT

An oil temperature is estimated without using an oil temperature sensor to determine engine oil degradation, so that the number of parts may be reduced. To detect the engine oil degradation, an estimated engine oil temperature is worked out. When a process for working out the estimated engine oil is initiated (S21), it is determined whether a thermostat is in an OPEN state or in an CLOSED state (S22). Next, an initial oil temperature is worked out (S23), and then a target oil temperature is worked out (S24). Lastly, an estimated oil temperature is worked out (S25), and the process is completed (S26). When the estimated oil temperature is worked out in step S25, alternative process steps may be selected according to the OPEN/CLOSED state of the thermostat.

4 Claims, 9 Drawing Sheets

ENGINE OIL DEGRADATION DETECTOR

BACKGROUND OF THE INVENTION

This invention relates to an engine oil degradation detector that detects degradation of engine oils used for an internal combustion engine such as an engine used in automobiles.

The engine oil is used for automotive engines or other internal combustion engines to lubricate contiguous components therein in relative motion. The engine oil becomes degraded with use, and thus need be changed as appropriate. It is conventionally recommended that the engine oil be changed when a specific time has passed or when a specific distance has been traversed.

However, various factors combine to cause the degradation of the engine oil in actuality. For example, unless the internal combustion engine has been driven, it turns out, even after a long time has passed since the engine oil was last changed, that the engine oil has not yet been degraded so much. Likewise, rough driving would rapidly degrade the engine oil, irrespective of a shorter distance traveled. Thus, as is often the case, the degradation of the engine oil could not be precisely detected on a basis of a lapse of time or a distance traveled. In view of these circumstances, Japanese Laid-Open Patent Application, Publication No. 62-203915 A, discloses a method of detecting degradation of oils with consideration given to a driving manner under the title, "METHOD FOR INDICATING NECESSITY OF CHANGING ENGINE OIL". This method employs a temperature of the oil as a factor for determining degradation of the oil. The temperature is monitored to add some counts to the measurement of the effective number of revolutions of an engine when the temperature of oil is considerably higher or considerably lower than a predetermined temperature. Then, the effective numbers of revolutions are added up, and when the integrated number of revolutions reaches a predetermined specific value, it is determined that the time has come when the engine oil should be changed.

However, the above-described conventional technique employs an oil temperature sensor that detects a temperature of oil to determine how the oil is degraded. The oil temperature sensor is dedicated to the determination of the degradation of oil, and thus the conventional technique causes increase in the number of parts as the oil temperature sensor is to be provided. The increase in the number of parts entails increase in cost, additional space required for attachment of the parts, and other disadvantages.

The above disclosure indicates that the oil temperature may be worked out from any other predetermined value, but not refers to a specific methodology therefor.

Therefore, there is a need to reduce the number of parts in an engine oil degradation detector, and it is an object of the present invention to provide an engine oil degradation detector capable of estimating a temperature of the oil without using an oil temperature sensor.

SUMMARY OF THE INVENTION

According to one aspect of the present invention, which may eliminate the above disadvantages and achieve the above object, there is provided an engine oil degradation detector as set forth in claim 1 that works out a use level of an engine oil in accordance with a driving manner of the internal combustion engine. The use level of the engine oil indicates how much the engine oil in an internal combustion engine has been used. The engine oil degradation detector includes an engine oil temperature estimation means that estimates a temperature of the engine oil. The use level of the engine oil is corrected with an engine oil degradation coefficient obtained according to the temperature of the engine oil estimated by the engine oil temperature estimation means. The engine oil degradation detector integrates the corrected use levels of the engine oil, and determines that a time to change the engine oil has come when the integrated use level reaches a predetermined value indicating a usable life of the engine oil. The engine oil estimation means works out an estimated engine oil temperature based upon a cooling water temperature of cooling water that cools the internal combustion engine, and an open/closed state of a control valve provided in a cooling water channel.

According to the invention as in claim 1, the engine oil temperature is estimated based upon the cooling water temperature of the cooling water and the open/closed state of the control valve. Therefore, an oil temperature sensor that detects the engine oil temperature is not required, and thus the number of parts may be reduced. Moreover, the change in temperature of the cooling water and the engine oil is largely dependent upon the open/closed state of a control valve, and thus the temperature of the engine oil may be accurately estimated based upon the open/closed state of the control valve.

According to another aspect of the present invention, as set forth in claim 2 that depends upon claim 1, the engine oil temperature estimation means works out the estimated engine oil temperature in accordance with elapsed time of driving of the internal combustion engine, and the elapsed time is corrected in accordance with a driving manner of the internal combustion engine when the control valve is closed.

According to the invention as in claim 2, correction is made to a lapse of time based upon a driving manner using the open/closed state of the control valve that changes with a lapse of time. Therefore, the difference in tendency of the oil temperature increase may accurately be reflected on the estimate.

According to another aspect of the present invention, as set forth in claim 3 that depends upon claim 1, the engine oil temperature estimation means corrects the cooling water temperature in accordance with a driving manner of the internal combustion engine, and works out the estimated engine oil temperature based upon the corrected cooling water temperature.

According to the invention as in claim 3, the water temperature is corrected in accordance with a driving manner of the internal combustion engine when the control valve is open. Therefore, the difference in tendency of the temperature increase between oil and water may be corrected, so that the oil temperature may accurately be estimated.

According to another aspect of the present invention, as set forth in claim 4 that depends upon claim 1, the engine oil temperature estimation means works out an initial value of the estimated engine oil temperature in accordance with a soaking state of the internal combustion engine.

According to the invention as in claim 4, an initial value of the estimated engine oil may be set in accordance with a soaking state, i.e., a standby state that appears from suspension until restarting of the internal combustion engine. Therefore, the temperature of the engine oil may accurately be estimated even when the internal combustion engine is started soon after the internal combustion engine is stopped.

Other objects and further features of the present invention will become readily apparent from the following description of preferred embodiments with reference to accompanying drawings.

DETAILED DESCRIPTION OF THE PREFERRED EMBODIMENTS

A description will be given in details of an exemplified embodiment of the present invention with reference to the drawings.

Figure 1:
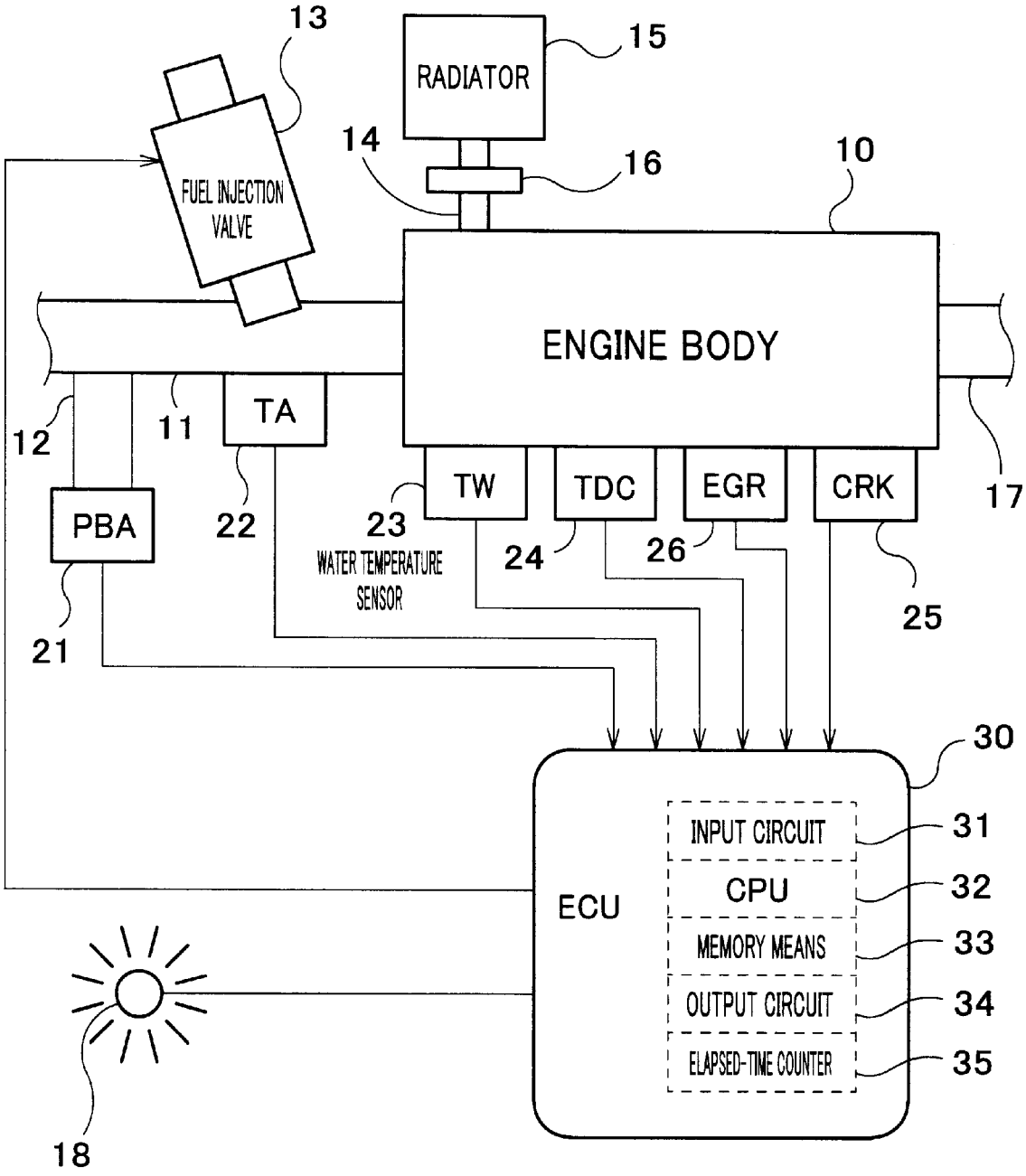
FIG. 1 is a block diagram showing a structure of an engine oil degradation detector according to the present invention.

FIG. 1 is a block diagram showing a structure of an engine oil degradation detector according to the present invention.

As shown in FIG. 1, an intake pipe 11 is connected to an engine body 10 as an internal combustion engine. With the intake pipe 11 is coupled a branch pipe 12, to which an absolute pressure sensor 21 is attached. The absolute pressure sensor 21 determines a pressure in the intake pipe 11. In the intake pipe 11, an intake manifold (not shown) is formed downstream of a position where a throttle valve is located. In the intake manifold, each cylinder includes a fuel injection valve (injector) 13 upstream of an intake valve provided in each cylinder. The fuel injection valve 13, which is mechanically connected with a fuel pump, receives a fuel injected from the fuel pump and jets the injected fuel through each cylinder.

An outside-air temperature sensor 22 is provided downstream of the intake pipe 11. The outside-air temperature sensor 22 detects a temperature of outside air flowing into the intake pipe 11. Further, a water temperature sensor 23 is provided in a cooling water channel of the engine body 10. The water temperature sensor 23 detects a water temperature of cooling water flowing in the cooling water channel to cool the engine body 10.

The cooling water channel of the engine body 10 is connected with a radiator 15 via a cooling water path 14. The cooling water that gets heated during cooling the engine body 10 is fed to the radiator 15 and cooled in the radiator 15. The cooling water cooled in the radiator 15 is fed again to the cooling water channel of the engine body 10 to cool the engine body 10. Thus, the cooling water is circulated and fed to the engine body 10, and cools the engine body 10.

A thermostat 16 as a control valve in the present invention is provided in the cooling water path 14. The thermostat 16 is an opening/closing valve made for example of bimetals, and, when the temperature of the cooling water is low enough, stops the cooling water from being fed from the radiator 15 to the engine body 10 by closing the cooling water path 14. On the other hand, when the temperature of the cooling water in the cooling water channel of the engine body 10 becomes higher, the thermostat 16 switches to open the cooling water path 14, so that the cooling water in the radiator 15 may be circulated and fed to the engine body 10. Further, an exhaust pipe 17 is connected with the engine body 10. Exhaust gas generated in the engine body 10 is discharged through the exhaust pipe 17 to an external unit in which a predetermined treatment is given.

A TDC (Top Dead Center) sensor 24 and a crank angle sensor 25 are provided near a camshaft or crankshaft in the engine body 10. Further, in an EGR (Exhaust Gas Recirculation) valve (not shown) that controls an EGR amount is provided an EGR sensor 26 that detects a lift amount of the EGR valve.

The TDC sensor 24 detects a crank angle of a TDC position of a piston. The crank angle sensor 25 detects the crank angle at intervals shorter than those at which the TDC sensor 24 detects the crank angle of the TDC position of the piston. The EGR sensor 26 detects the lift amount of the EGR valve, and an ECU 30 that will be described later works out an EGR amount based upon the detected lift amount of the EGR valve.

Further, an alarm 18 indicating that the oil is degraded and needed changing is provided at a driver's seat (not shown) or the like. The alarm 18 includes an alarm lamp, and, when a warning signal is input, turns the alarm lamp on to indicate that the time to change oil has come.

The absolute pressure sensor 21, outside-air temperature sensor 22, water temperature sensor 23, TDC sensor 24, crank angle sensor 25, and EGR sensor 26 are connected with an Electronic Control Unit (hereinafter referred to as "ECU") 30. The ECU 30 is made up of a microcomputer, and includes an input circuit 31, a Central Processing Unit (hereinafter referred to as "CPU") 32, a memory means 33, an output circuit 34, and an elapsed-time counter 35. The input circuit 31 shapes a waveform of an input signal from each sensor, converts a voltage level, converts an analog signal into a digital signal, and performs other kinds of processing. The CPU 32 performs a logical operation based upon the input signal received from each sensor and digitized in the input circuit. The memory means 33 includes a RAM that stores an arithmetic program for various operations executed in the CPU 32, and a memory that stores a result of the operation in the CPU 32. The memory means 33 also stores the corrected numbers of revolutions of the crank worked out from the number of revolutions of the crank and the oil temperature, and the total number of revolutions of the crank resulted from adding operation of the corrected numbers of revolutions of the crank. Further the memory means 33 stores a water temperature and estimated oil temperature when the use of the vehicle is completed and the engine is turned off. The output circuit 34 outputs a control signal or the like based upon the operation result worked out in the CPU 32 to the fuel injection valve 13 or the alarm 18. The elapsed-time counter 35 includes a timer that counts elapsed time, for example, every 10 ms, after the counter is reset, and continues to count the elapsed time till the counter is reset.

The ECU 30 works out an estimate of a temperature of engine oil (hereinafter referred to as "oil temperature") based upon a water temperature of cooling water detected by the water temperature sensor 23, and an OPEN/CLOSED state of the thermostat 16. On the other hand, the TDC sensor 24 and crank angle sensor 25 detects the number of revolutions of the crank. The estimation of the oil temperature is carried out based upon the water temperature of cooling water detected by the water temperature sensor 23, the OPEN/CLOSED state of the thermostat 16, and other factors. The number of revolutions of the crank is detected using the TDC sensor 24 and the crank angle sensor 25.

When the crank of the engine rotates, the engine oil becomes dirty with the rotation of the crank. When the engine oil becomes much dirtier, the engine oil becomes degraded, and finally the necessity of changing oil arises. Accordingly, the present embodiment employs the number of revolutions as a use level of the engine oil that indicates how much the engine oil has been used with consideration given to a driving manner. Thus, it is determined that the usable life of the engine oil has expired when the number of revolutions has reached a predetermined value. It is understood that the relationship between the number of revolutions of the crank and the degradation of the engine oil is not simply proportional but depends upon the temperature of the engine oil. Specifically, the engine oil has an appropriate range of temperature for use, and if the temperature gets out of the range, even if the same amount of the engine oil is used, the engine oil degrades more. Consequently, we propose that the effective amount of engine oil used should be corrected using the oil temperature, so as to detect degradation of the engine oil more accurately. A description will be given one by one of the specific process steps for determining degradation of the engine oil that are carried out in the ECU 30 with reference to the flowcharts.

Figure 3:
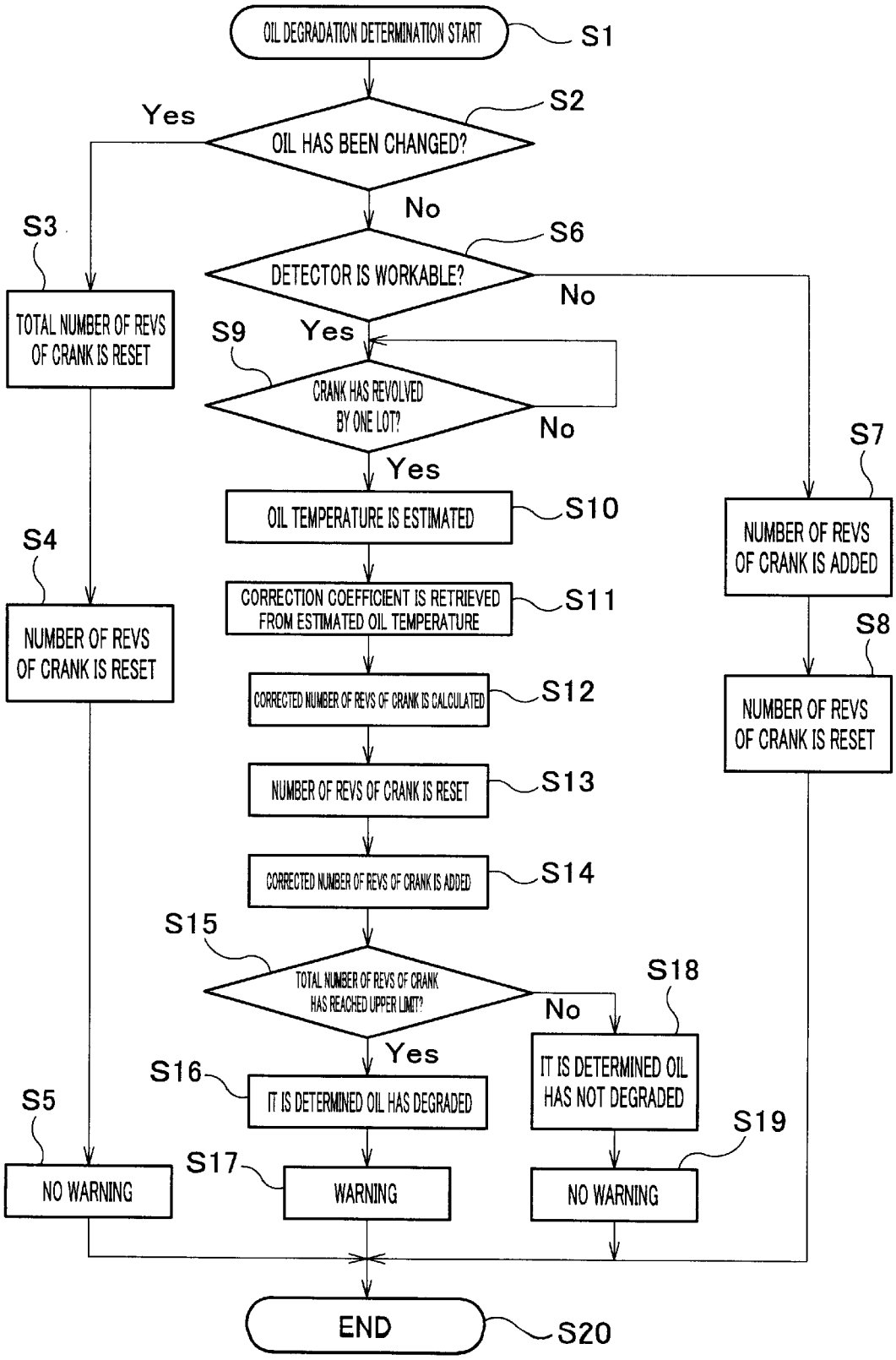
FIG. 3 is a flowchart showing a series of steps for determining oil degradation.

FIG. 3 is a flowchart showing a series of steps for determining oil degradation. The degradation of the engine oil is detected according to these steps.

When the oil degradation determination is initiated (S1), it is first determined whether oil has been changed (S2). Whether the oil has been changed may be determined for example by determining whether a reset button (not shown) has been pressed. The oil is changed for example by manual operation of an operator, and the operator who has finished changing the oil or a user of the vehicle or others is supposed to press the reset button after the oil change, and it is thereby determined that the oil has been changed. When it is determined that the oil has been changed, the total number of revolutions of the crank is reset to zero (S3). Likewise, the number of revolutions of the crank measured per a lot is reset (S4). The lot is defined as a unit to be counted every time the crank revolves a predetermined number of times. From zero, the number of revolutions of the crank will be added every lot, and when the number of revolutions of the crank reaches a predetermined upper limit, a user of the vehicle or other persons concerned will be prompted to change the oil. However, since the engine oil has not degraded yet at this stage, the alarm 18 does not give any warning indication (S5).

When it is determined in step S2 that the oil has not been changed, the sensors are tested for failures to determine as a workability check whether the engine oil degradation detector works well without failures in the sensors (S6). As a result, if it is determined that the detector does not pass the workability check due to a failure in any of the sensors or the like, the number of revolutions of the crank is simply added to the total number of revolutions of the crank without correction for the number of revolutions of the crank (S7). The number of revolutions of the crank is reset immediately after the addition to the total number of revolutions of the crank (S8). Then, the process terminates.

If it is determined in step S6 that the detector passes the workability check, it is determined whether the crank has revolved by one lot (S9). If the number of revolutions of the crank has not yet reached a predetermined number corresponding to one lot, e.g., one hundred revolutions, the number of revolutions of the crank is added until the number of revolutions of the crank reaches the number corresponding to one lot. If the number of revolutions of the crank has reached the number corresponding to one lot, an estimate of the oil temperature (hereinafter referred to as "estimated oil temperature") is worked out (S10). The process for estimating the oil temperature will be explained later.

Figure 2:
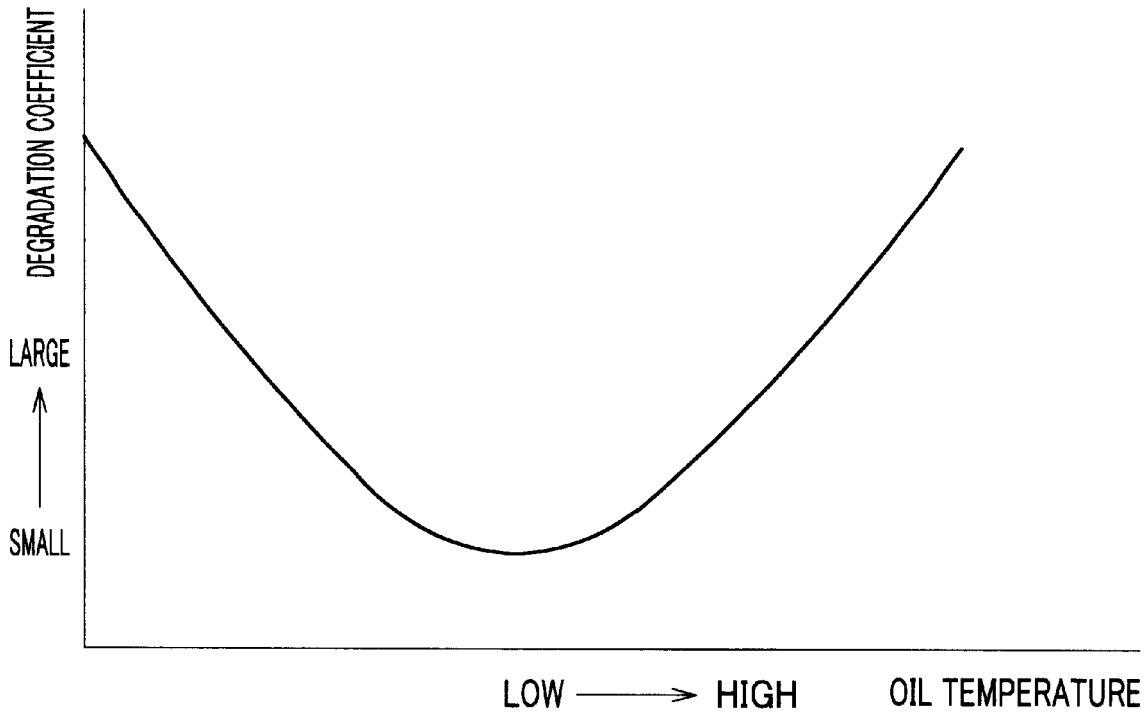
FIG. 2 is a graph showing a relationship between oil temperatures and degradation coefficients of engine oil.

When the oil temperature is estimated, a table shown in FIG. 2 is looked up to locate a correction coefficient based upon the oil temperature (S11). The correction coefficient corresponds to an engine oil degradation coefficient in the present invention.

After the correction coefficient is obtained, the number of revolutions of the crank corresponding to one lot is multiplied by the correction coefficient. It is understood that the engine oil degradation coefficient gets larger than an accumulated value if the oil temperature is too large or too small to fall within the normal range. Accordingly, if the oil temperature falls within the normal range, the correction coefficient approximates to one, but if the oil temperature is out of the normal range, the correction coefficient is larger in accordance with the distance from the normal range.

When the correction coefficient is located as above, the number of revolutions of the crank corresponding to one lot is multiplied by the correction coefficient to work out a corrected number of revolutions of the crank (S12). When the corrected number of revolutions of the crank is worked out, the number of revolutions of the crank to which the number corresponding to one lot has been added is reset to zero (S13). When the number of revolutions of the crank is reset to zero, the corrected number of revolutions of the crank is added to the total number of revolutions of the crank (S14). When the corrected number of revolutions of the crank is added to the total number of revolutions of the crank, it is determined whether the total number of revolutions of the crank has reached a predetermined upper limit of the total number of revolutions of the crank (S15). It is understood that the upper limit of the total number of revolutions of the crank may assume any values as appropriate, e.g., ten million revolutions. If the total number of revolutions of the crank has reached the upper limit of the total number of revolutions of the crank, it is determined that the oil has degraded (S16), and a warning signal is transmitted from the ECU 30 to the alarm 18 to give a warning indication (S17). The alarm 18 that has received the warning signal gives a predetermined warning indication such as lighting of a warning lamp, raising of an alarm. If it is determined in step S15 that the total number of revolutions of the crank has not reached the upper limit of the total number of revolutions of the crank yet, it is determined that the oil has not degraded (S18), and no warning indication is given (S19). The oil degradation determination process terminates with or without a warning indication as described above (S20).

Discussed above is a general flow of the oil degradation determination process, and it is characteristic of the present embodiment that the oil temperature estimation in step S10 is based upon a water temperature and an OPEN/CLOSED state of the thermostat 16. A description will be given below of a process for estimating an oil temperature.

Figure 4:
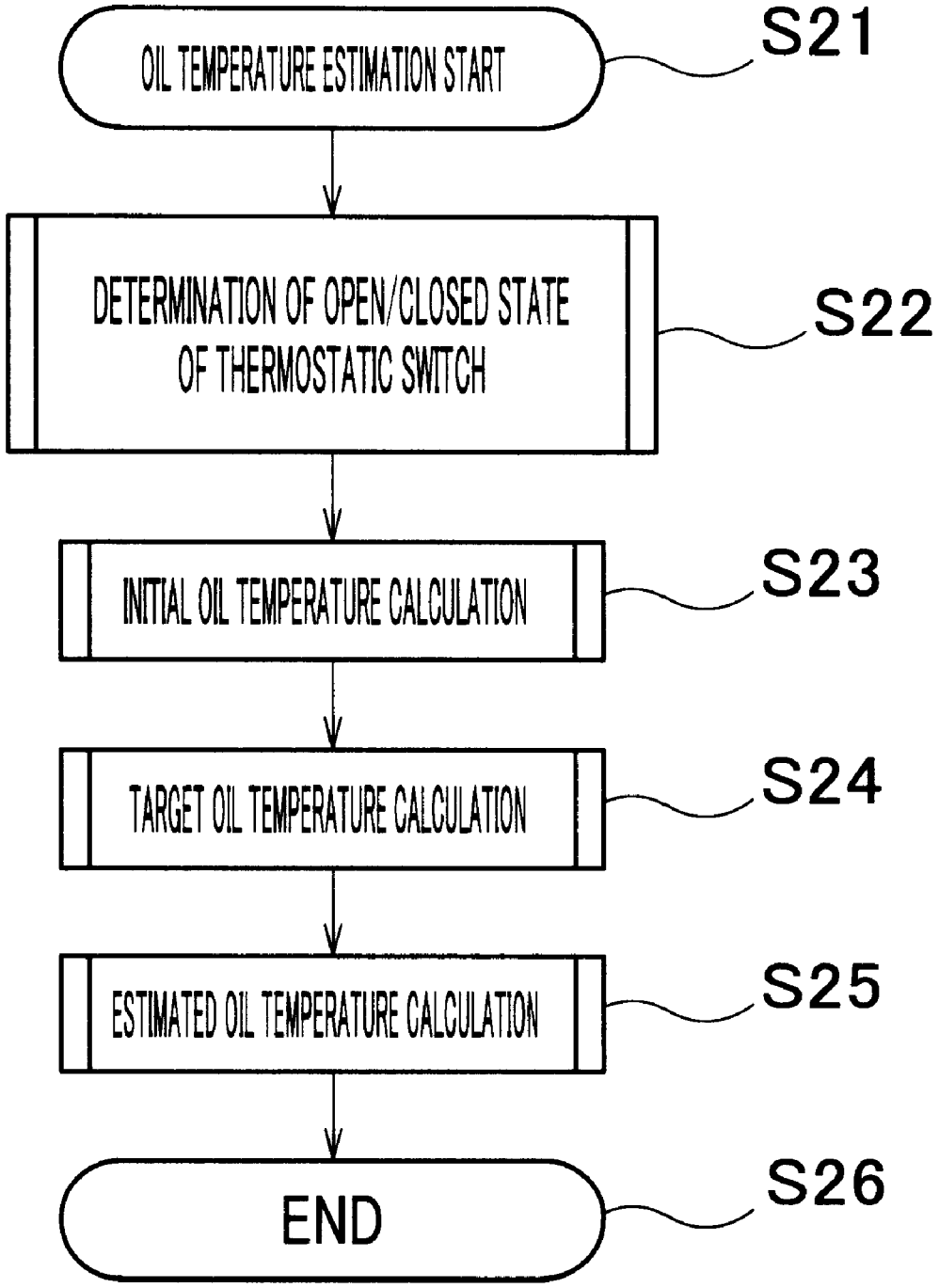
FIG. 4 is a flowchart showing an overall process for estimating an oil temperature.

FIG. 4 is a flowchart showing a process for estimating the oil temperature.

When the estimation of the oil temperature is initiated (S21), an OPEN/CLOSED state of the thermostat 16 is determined (S22). When the OPEN/CLOSED state of the thermostat 16 is determined, an initial value of the oil temperature is worked out (S23), and then a target value of the oil temperature is worked out (S24). Thereafter, the estimated value of the oil temperature is worked out (S25), and the process for estimating the oil temperature terminates (S26).

In order to work out the estimated oil temperature, an adopted basic approach is that: first, an initial oil temperature is worked out; then a target oil temperature is worked out; and thereafter an estimated oil temperature is worked out based upon the below equation (1).

$$\text{ESTIMATED OIL TEMPERATURE} = \text{INITIAL OIL TEMPERATURE} + (\text{TARGET OIL TEMPERATURE} - \text{INITIAL OIL TEMPERATURE}) \times \text{COEFFICIENT} \quad (1)$$

Hereupon, an OPEN/CLOSED state of the thermostat 16 is employed to work out the target oil temperature and other values. The coefficient used herein is an exponential function that becomes zero if elapsed time is zero, and limitlessly approaching one with a lapse of time. The coefficient is stored in the ECU 30 in the form of a table of which a column is the elapsed time, and a row is the coefficient.

A more specific description will be given herein of each process step. In describing the steps below, a reference will be made to FIG. 1 as appropriate.

First, a description will be given of determination of an OPEN/CLOSED state of the thermostat 16.

Figure 5:
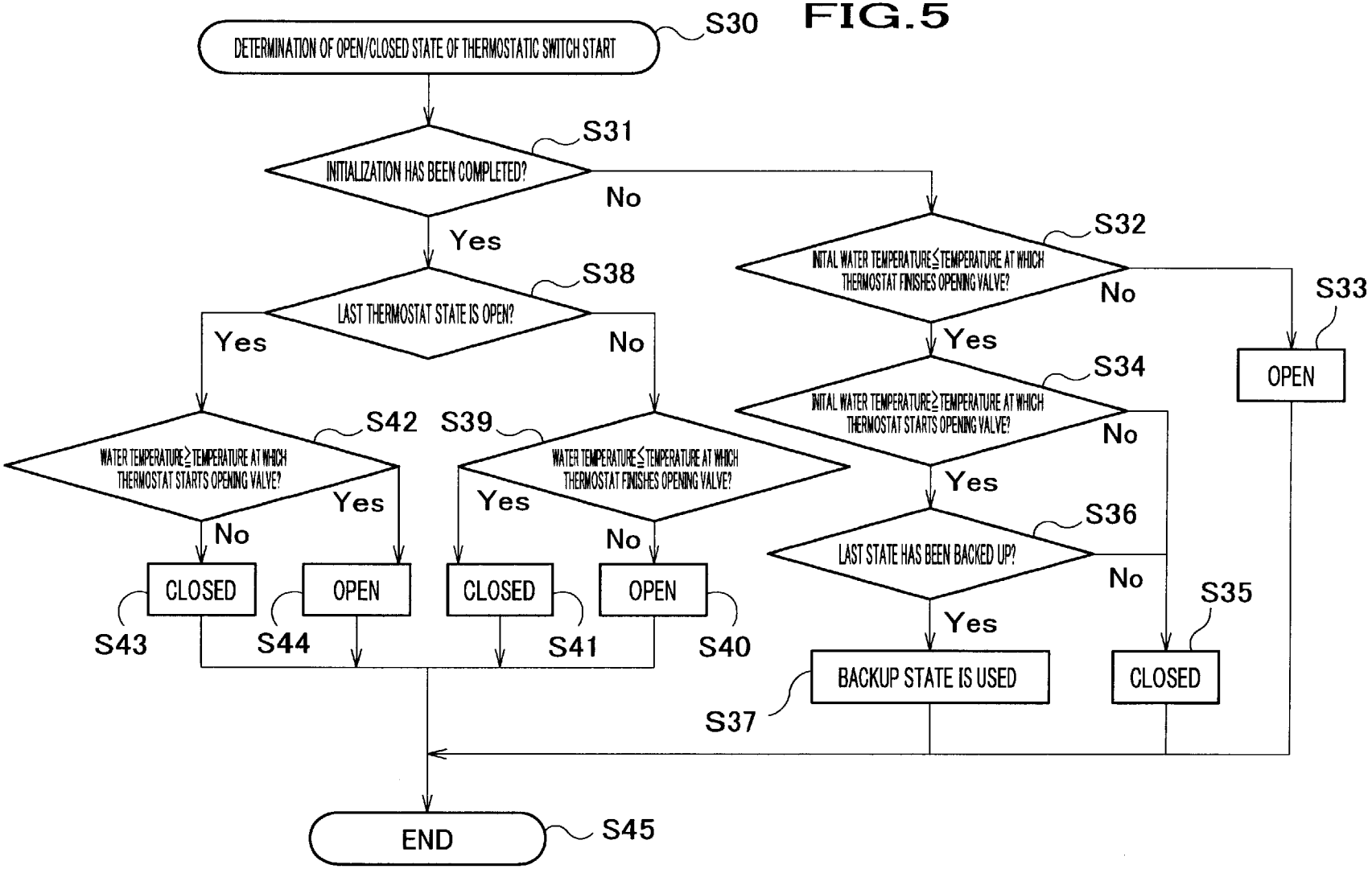
FIG. 5 is a flowchart showing process steps for determining an OPEN/CLOSED state of a thermostatic switch.

FIG. 5 is a flowchart showing process steps for determining the OPEN/CLOSED state of the thermostat 16.

When the determination of the OPEN/CLOSED state of the thermostat 16 is initiated (S30), it is determined whether an initialization has been completed (S31). If the initialization has not been completed yet, a reference value for an actual OPEN/CLOSED state of the thermostat 16 is not provided, and it is thus determined whether an initial water temperature of cooling water detected by the water temperature sensor 23 is equal to or lower than a temperature at which the thermostat 16 finishes opening a valve (S32). The temperature at which the thermostat 16 finishes opening the valve is predetermined according to performance of the thermostat 16. If the initial water temperature is higher than the temperature at which the thermostat 16 finishes opening the valve, it is determined that the thermostat is in an OPEN state (S33).

If it is determined that the initial water temperature is equal to or lower than the temperature at which the thermostat 16 finishes opening the valve, then it is determined whether the initial water temperature is equal to or lower than a temperature at which the thermostat 16 starts opening the valve (S34). The temperature at which the thermostat 16 starts opening the valve is predetermined according to the performance of the thermostat 16 like the temperature at which the thermostat 16 finishes opening the valve, and is lower than the temperature at which the thermostat 16 finishes opening the valve. If it is determined that the initial water temperature is lower than the temperature that the thermostat 16 starts opening the valve, it is determined that the thermostat is in a CLOSED state (S35). On the other hand, if it is determined that the initial water temperature is equal to or higher than the temperature at which the thermostat 16 starts opening the valve, as the water temperature does not teach the OPEN/CLOSED state of the thermostat 16, it is determined whether a state immediately before initialization has been backed up (S36). Resultantly, if it is determined that the prior state has been backed up, the backup state is used as the OPEN/CLOSED state of the thermostat 16 (S37). On the other hand, if it is determined in step S36 that the prior state has not been backed up, it is determined in step S35 that the thermostat 16 is in the CLOSED state.

If it is determined in step S31 that the initialization has been completed, it is determined based upon a past history whether it was determined last time that the thermostat 16 was in the OPEN state (S38). If the history teaches that it was determined last time that the thermostat 16 was in the CLOSED state, it is determined whether the water temperature of the cooling water detected by the water temperature sensor 23 is equal to or lower than the temperature at which the thermostat 16 finishes opening the valve (S39). Resultantly, if it is determined that the water temperature is higher than the temperature at which the thermostat 16 finishes opening the valve, it is determined that the thermostat 16 is the OPEN state (S40). If the water temperature is equal to or lower than the temperature at which the thermostat 16 finishes opening the valve, it is determined that the thermostat 16 is in the CLOSED state (S41). If the history teaches in step S38 that it was determined last time that the thermostat 16 was in the OPEN state, it is determined whether the water temperature is equal to or higher than the temperature at which the thermostat 16 starts opening the valve (S42). Resultantly, if it is determined that the water temperature is lower than the temperature at which the thermostat 16 starts opening the valve, it is determined that the thermostat 16 is in the CLOSED state (S43). Conversely, if it is determined that the water temperature is equal to or higher than the temperature at which the thermostat 16 starts opening the valve, it is determined that the thermostat 16 is in the CLOSED state (S44). Thus, the process for determining the OPEN/CLOSED state of the thermostat 16 terminates (S45). The resultant determination of the OPEN/CLOSED state of the thermostat 16 will be utilized in a post-process.

Next, a description will be given of a process for working out the initial oil temperature.

The initial oil temperature is worked out in accordance with a soaking state of the engine body 10. A description will be given herein of a specific process thereof with reference made principally to FIG. 6.

Figure 6:
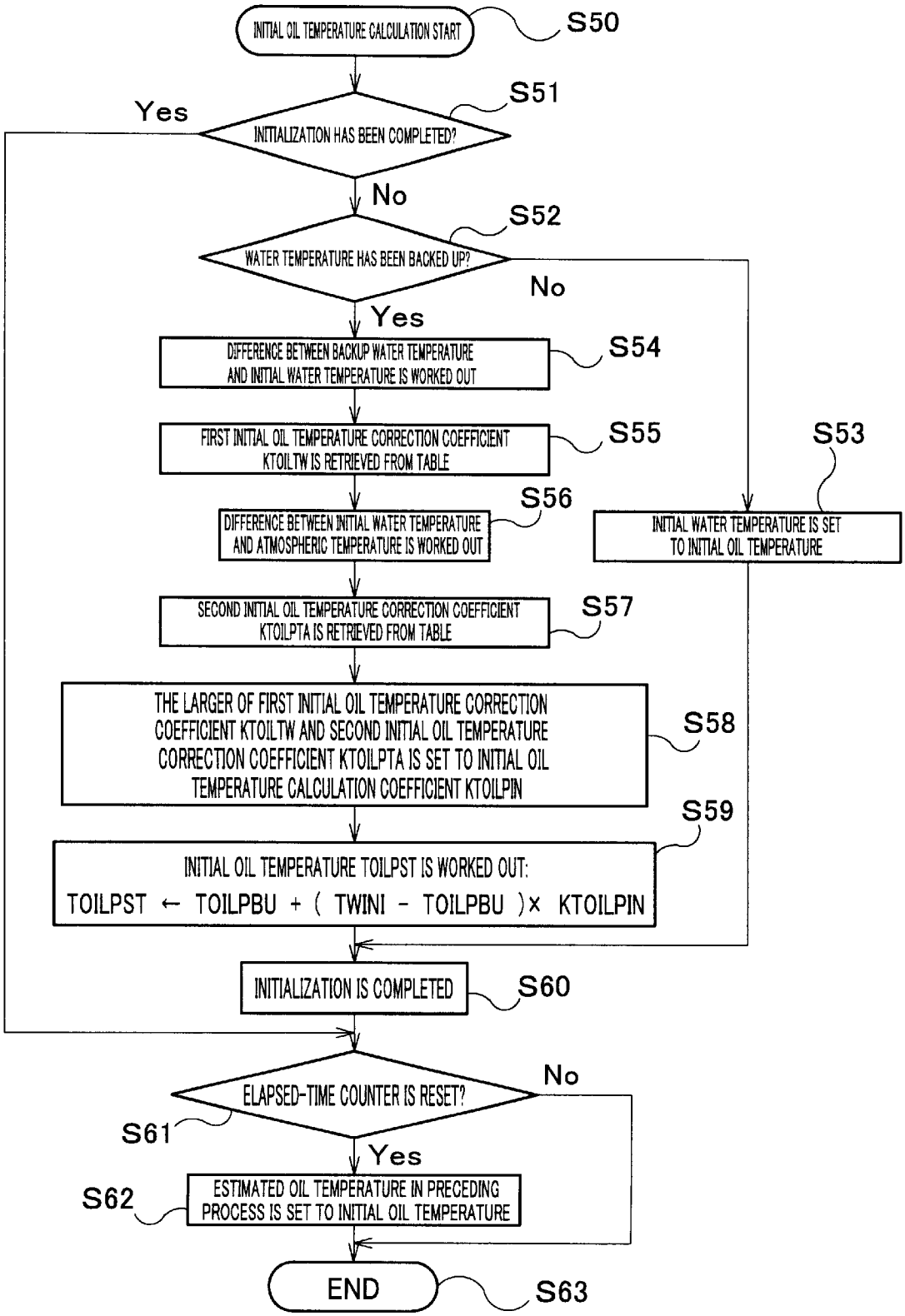
FIG. 6 is a flowchart showing process steps for calculating an initial oil temperature.

FIG. 6 is a flowchart showing process steps for working out the initial oil temperature.

When the process for working out the initial oil temperature is initiated (S50), it is determined whether initialization has been completed (S51). If it is determined that the initialization has been completed, the process goes to step S60 that will be described later. If it is determined that the initialization has not been completed yet, it is determined whether the water temperature has been backed up (S52). If it is determined that the temperature has not been backed up, the initial water temperature is set to the initial oil temperature (S53), and the process goes to step S59 that will be described later. If the water temperature has been backed up, the difference between the backup water temperature and the initial water temperature detected by the water temperature sensor 23 is worked out (S54). Subsequently, an initial oil temperature correction coefficient table is looked up to locate a correction coefficient based upon the difference between the backup water temperature and the initial water temperature (the coefficient is hereinafter referred to as "first initial oil temperature correction coefficient" or KTOILTW) (S55). The first initial oil temperature correction coefficient KTOILTW is a coefficient for use in correction based upon the soaking state of the engine; in this embodiment, the soaking state is estimated according to a change in water temperature from the time when the engine stops till the engine starts driving. Coefficients indicating the change in the oil temperature corresponding to the change in the water temperature are shown in the initial oil temperature correction coefficient table. For example, the oil temperature is slower in lowering than the water temperature, and thus the coefficient is such that the decrease in the oil temperature is smaller than the decrease in the water temperature. To be more specific, for example, if the water temperature lowers by 20 degrees, the oil temperature lowers by 15 degrees.

When the first initial oil temperature correction coefficient KTOILTW is located, the difference between the initial water temperature and an atmospheric temperature (outside air temperature) detected by the outside-air temperature sensor 22 is worked out (S56). Subsequently, the initial oil temperature correction table is looked up to locate a coefficient based upon the difference between the initial water temperature and the atmospheric temperature (the coefficient is hereinafter referred to as "second initial oil temperature correction coefficient" or KTOILPTA) (S57). The second initial oil temperature correction coefficient KTOILPTA is a coefficient for use in correction based upon the soaking state of the engine like the above first initial oil temperature correction coefficient KTOILTW, but employs the change of the water temperature, i.e., the extent to which the water temperature is approaching the outside air temperature, to estimate the soaking state. The initial oil temperature correction table is the same as that which is used to locate the first initial oil temperature correction coefficient KTOILTW.

Further, the first initial oil temperature correction coefficient KTOILTW and second initial oil temperature correction coefficient KTOILPTA that are obtained in the previous steps are compared, and the larger is set to an initial oil temperature calculation coefficient KTOILPIN (S58). This is because the use of the larger correction coefficient, i.e., the coefficient that permits longer soaking state, may allows a more correct soaking state to be reflected in the initial oil temperature.

When the initial oil temperature calculation coefficient KTOILPIN is obtained as above, the initial oil temperature is worked out according to the equation (2):

$$TOILPST=TOILPBU+(TWINI-TOILPBU)\times KTOILPIN \quad (2)$$

where TOILPST is an initial oil temperature; TOILPBU is a backup oil temperature; TWINI is an initial water temperature; and an initial oil temperature correction coefficient.

When the initial oil temperature TOILPST is obtained, the initialization is completed (S60). After the initialization is completed, it is determined whether an elapsed-time counter has been reset (S61). If the elapsed-time counter has been reset, the estimated oil temperature obtained in the preceding process is set to the initial oil temperature. This is because when it is determined in step S93 of the flowchart shown in FIG. 8 as will be described later that an estimated oil temperature curve intersects a target oil temperature curve and the estimated oil temperature at the intersection point is set to an initial oil temperature, the elapsed-time counter is reset to zero, elapsed time is counted from the beginning, and the initial oil temperature and the elapsed time are used to work out the estimated oil temperature. If the elapsed-time counter has not been reset, the initial oil temperature is not set because the initial oil temperature already calculated last time is used. Thus, the process for working out the initial oil temperature is completed (S62).

Next, a description will be given of a process for working out a target oil temperature.

The target oil temperature is worked out by adding to a water temperature detected by the water temperature sensor 23 an increase of the oil temperature that rises in accordance with operation states of the engine and may thus estimated from operation conditions of the engine.

Next, a description will now be given of a specific process for calculation with reference made principally to FIG. 7.

Figure 7:
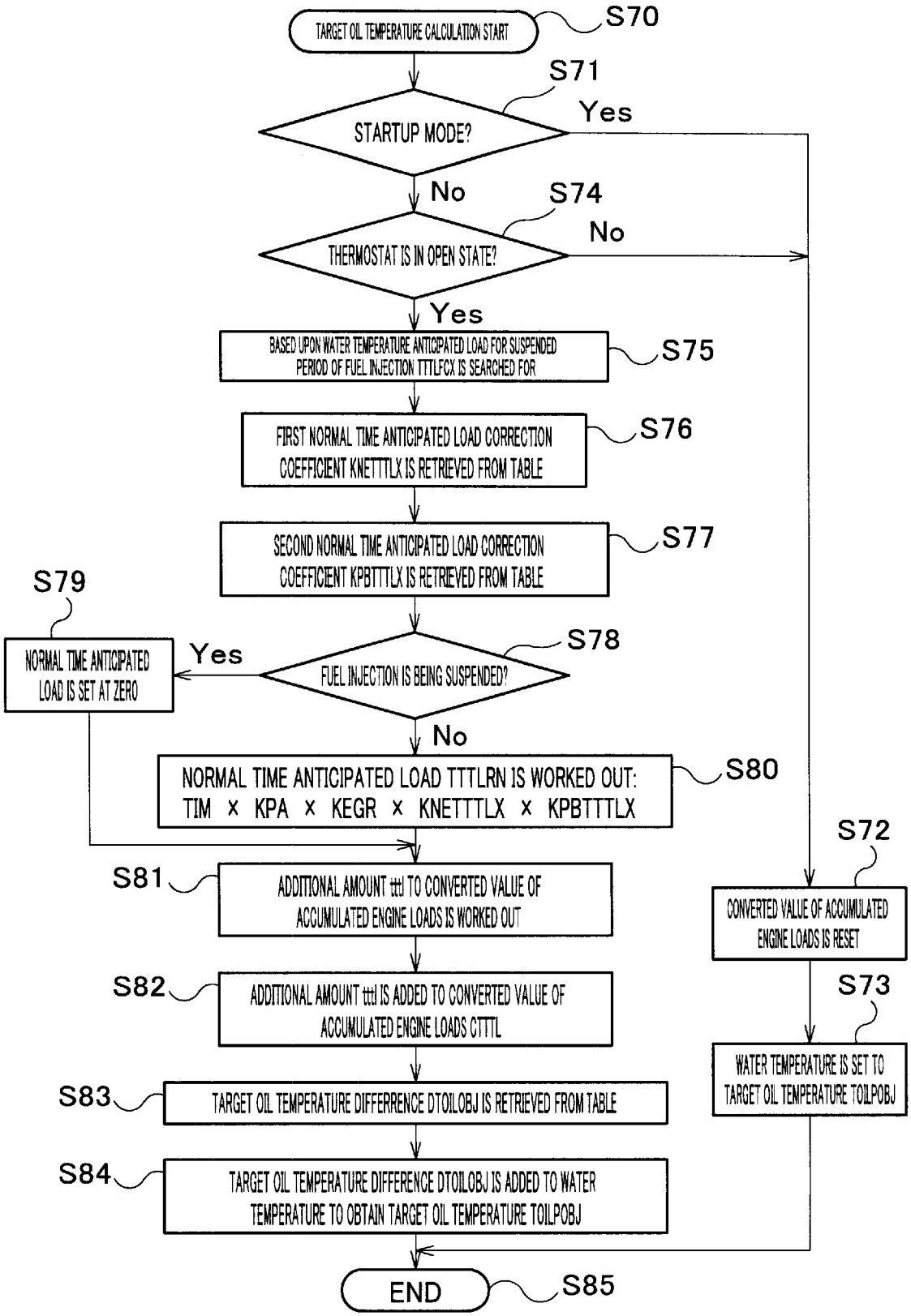
FIG. 7 is a flowchart showing process steps for calculating a target oil temperature.

FIG. 7 is a flowchart showing process steps for working out the target oil temperature.

When the process for working out the target oil temperature is initiated (S70), it is determined whether the engine is in a startup mode (S71). The startup mode is a mode in which the engine is controlled from starting till getting ignited. If it is determined in step S71 that the engine is in the startup mode, a converted value of accumulated engine loads is reset (S72). Subsequently, the water temperature detected by the water temperature sensor 23 is set to and used as the target oil temperature TOILPOBJ (S73).

If it is determined in step S71 that the engine is not in the startup mode, it is determined whether the thermostat 16 is in the OPEN state (S74). The OPEN/CLOSED state of the thermostat 16 may be determined using the result obtained in step S22 shown in FIG. 4. It is understood that when the thermostat 16 is in the CLOSED state, the temperature of the cooling water is low enough. The low temperature of the cooling water indicates that a load applied to the engine is not so high. Accordingly, if it is determined in step S74 that the thermostat 16 is in the CLOSED state, the converted value of accumulated engine loads is reset as in the startup mode (S72). Thereafter, the water temperature detected by the water temperature sensor 23 is set to and used as the target oil temperature TOILPOBJ (S73).

On the other hand, if it is determined in step S74 that the thermostat 16 is in the OPEN state, it is determined that cooling water is circulated and supplied from the radiator 15 to the engine body 10, and that a high load is applied to the engine. Therefore, the target oil temperature is worked out from the load applied to the engine.

Based upon the water temperature of the cooling water detected by the water temperature sensor 23, an anticipated load applied to the engine body 10 in which a fuel is not injected from the fuel injection valve 13 (hereinafter referred to as "anticipated load for the suspended period of fuel injection" or TTTLFCX) is searched for (S75). To locate the anticipated load, a table provided in the ECU 30 is looked up. The table indicates a correspondence between the water temperature detected by the water temperature sensor 23 for the suspended period of fuel injection, and the anticipated load applied to the engine.

When the anticipated load for the suspended period of fuel injection TTTLFCX is located, a load added for the period of fuel injection from the fuel injection valve 13 is detected. The load added for the period of fuel injection from the fuel injection valve 13 may be worked out from the number of revolutions of the engine and an absolute pressure applied to the intake manifold. Therefore, the number of revolutions of the engine NE is worked out based upon the crank angle detected by the TDC sensor 24 and crank angle sensor 25, or the like. Based upon the number of revolutions of the engine NE, a correction coefficient for a load applied by rotary action of the engine during normal time (hereinafter referred to as "first normal time anticipated load correction coefficient" or KNETTTLX) is retrieved from a first normal time anticipated load correction coefficient table (S76). The first normal time anticipated load correction coefficient table indicates the first normal time anticipated load correction coefficients KNETTTLX corresponding to the numbers of revolutions of the engine NE; the more the number of revolutions of the engine NE, the larger the first normal time anticipated load correction coefficient KNETTTLX becomes.

When the first normal time anticipated load correction coefficient KNETTTLX is retrieved, based upon an absolute pressure applied to the intake manifold (hereinafter referred to as "intake manifold absolute pressure") PB detected by the absolute pressure sensor 21, a correction coefficient for a load applied by the intake manifold absolute pressure PB during normal time (hereinafter referred to as "second normal time anticipated load correction coefficient" or KPBTTTLX) is retrieved from a second normal time anticipated load correction coefficient table (S77). The second normal time anticipated load correction coefficient table indicates the second normal time anticipated load correction coefficients KPBTTTLX corresponding to the intake manifold absolute pressures PB; the larger the intake manifold absolute pressure PB, the larger the second normal time anticipated load correction coefficient KPBTTTLX becomes.

At the same time, a basic injection amount TIM, an atmospheric pressure correction coefficient KPA, and an EGR recirculation ratio correction coefficient KEGR are also worked out. The ECU 30, which controls the fuel injection valve 13, works out an amount of fuel injection through the fuel injection valve 13 based upon how wide the throttle is open, and outputs an injection amount signal to the fuel injection valve 13. The injection amount signal is used to determine the basic injection amount TIM of the fuel injection valve 13. The atmospheric pressure correction coefficient KPA is a correction coefficient based upon a change of an atmospheric pressure. The EGR recirculation ratio correction coefficient KEGR is retrieved from an EGR recirculation ratio correction coefficient table, which may be looked up on an EGR amount detected by the EGR sensor 26. The EGR recirculation ratio correction coefficient table indicates the EGR recirculation ratio correction coefficients KEGR corresponding to the EGR amounts; the larger the EGR amount, the smaller the EGR recirculation ratio correction coefficient KEGR becomes.

When the first normal time anticipated load correction coefficient KNETTTLX and the second normal time anticipated load correction coefficient KPBTTTLX each corresponding to the number of revolutions of the engine NE and the intake manifold absolute pressure PB are located as above, it is determined whether the fuel injection from the fuel injection valve is being suspended (S78). Resultantly, if the fuel injection is being suspended, the normal time anticipated load is set at zero (S79).

On the other hand, if it is determined that the fuel injection is not being suspended, i.e., the fuel is being injected, the normal time anticipated load TTTLRN is worked out (S80). The normal time anticipated load TTTLRN may be expressed according to the following equation (3):

$$TTTLRN = TIM \times KPA \times KEGR \times KNETTTLX \times KPBTTTLX \quad (3)$$

where the TTTLRN denotes the normal time anticipated load; TIM denotes the basic injection amount; KPA denotes the atmospheric pressure correction coefficient; KEGR denotes the EGR recirculation ratio correction coefficient; KNETTTLX denotes the first normal time anticipated load correction coefficient; and KPBTTTLX denotes the second normal time anticipated load correction coefficient.

When the normal anticipated load TTTLRN is worked out, the difference between the normal time anticipated load TTTLRN and the anticipated load for the suspended period of the fuel injection TTTLFCX is worked out as an additional amount tttl to the converted value of accumulated engine loads (S81). The additional amount is added to the accumulated engine loads to work out a current value of the accumulated engine load CTTTL (S82).

When the accumulated engine load CTTTL is worked out, a difference of the target oil temperature with the water temperature of the cooling water (hereinafter referred to as "target oil temperature difference" or DTOILOBJ) is retrieved from a target oil temperature table based upon the accumulated engine load CTTTL (S83). The target oil temperature table indicates the target oil temperature differences DTOILOBJ corresponding to the accumulated engine loads CTTTL; the larger the accumulated engine load CTTTL, the larger the target oil temperature difference DTOILOBJ becomes. The target oil temperature difference is added to the water temperature detected by the water temperature sensor 23, and thereby the target oil temperature TOILPOBJ is worked out (S84). Accordingly, the target oil temperature TOILPOBJ is worked out, and the process for working out the target oil temperature is completed (S85). The above process for working out the target oil temperature may accurately estimate the oil temperature by setting the water temperature to the target oil temperature when the thermostat is in the CLOSED state, while calculating a difference between the oil temperature and the water temperature using an engine load when the thermostat is in the OPEN state in which the oil temperature is higher than the water temperature.

Next, a description will be given of the process for working out an estimated oil temperature with reference made principally to FIG. 8.

The basic approach for working out the estimated oil temperature is to estimate the oil temperature based upon an initial oil temperature using elapsed time. The elapsed time is corrected based upon the OPEN/CLOSED state of the thermostat 16 and the operation states of the engine body 10, so that the estimated oil temperature may be worked out more accurately. Hereupon, an elementary value to be added to the elapsed time is determined to count the elapsed time, and the elementary value to be added to the elapsed time may for example be one second.

A description will now be given of a specific calculation process with reference made principally to FIG. 8.

Figure 8:
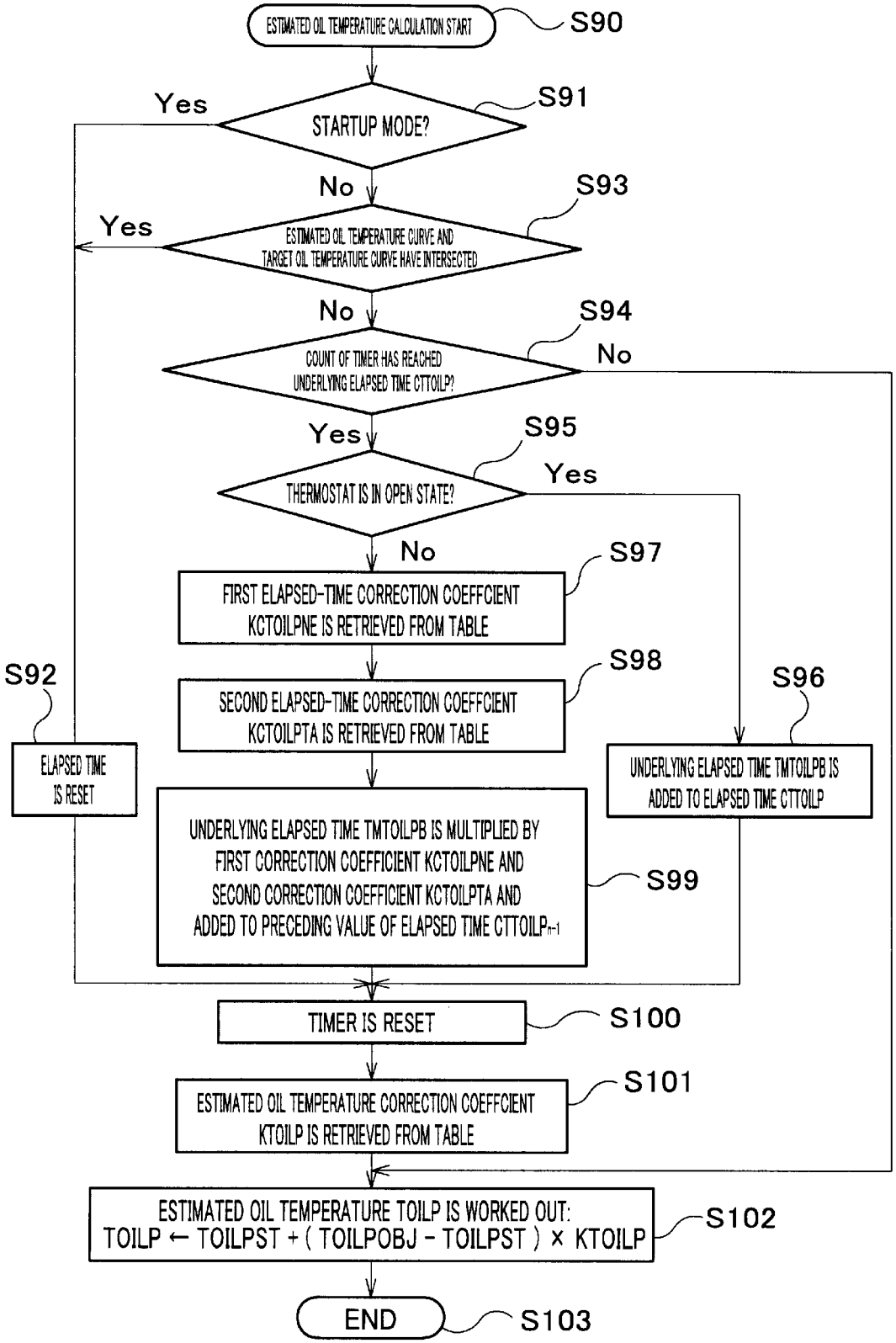
FIG. 8 is a flowchart showing process steps for calculating an estimated oil temperature.

FIG. 8 is a flowchart showing process steps for working out the estimated oil temperature.

When the process for working out the estimated oil temperature is initiated (S90), it is determined whether the engine is in a startup mode (S91). If it is determined that the engine is in the startup mode, the elapsed time is reset (S92), and another process is performed. Then, after the startup mode is completed, a count of the elapsed time is started, and the oil temperature is estimated based upon the following process steps . This is because the engine is not ignited in the startup mode, and thus the oil temperature does not rise, so that the elapsed time need not be counted.

Figure 9:
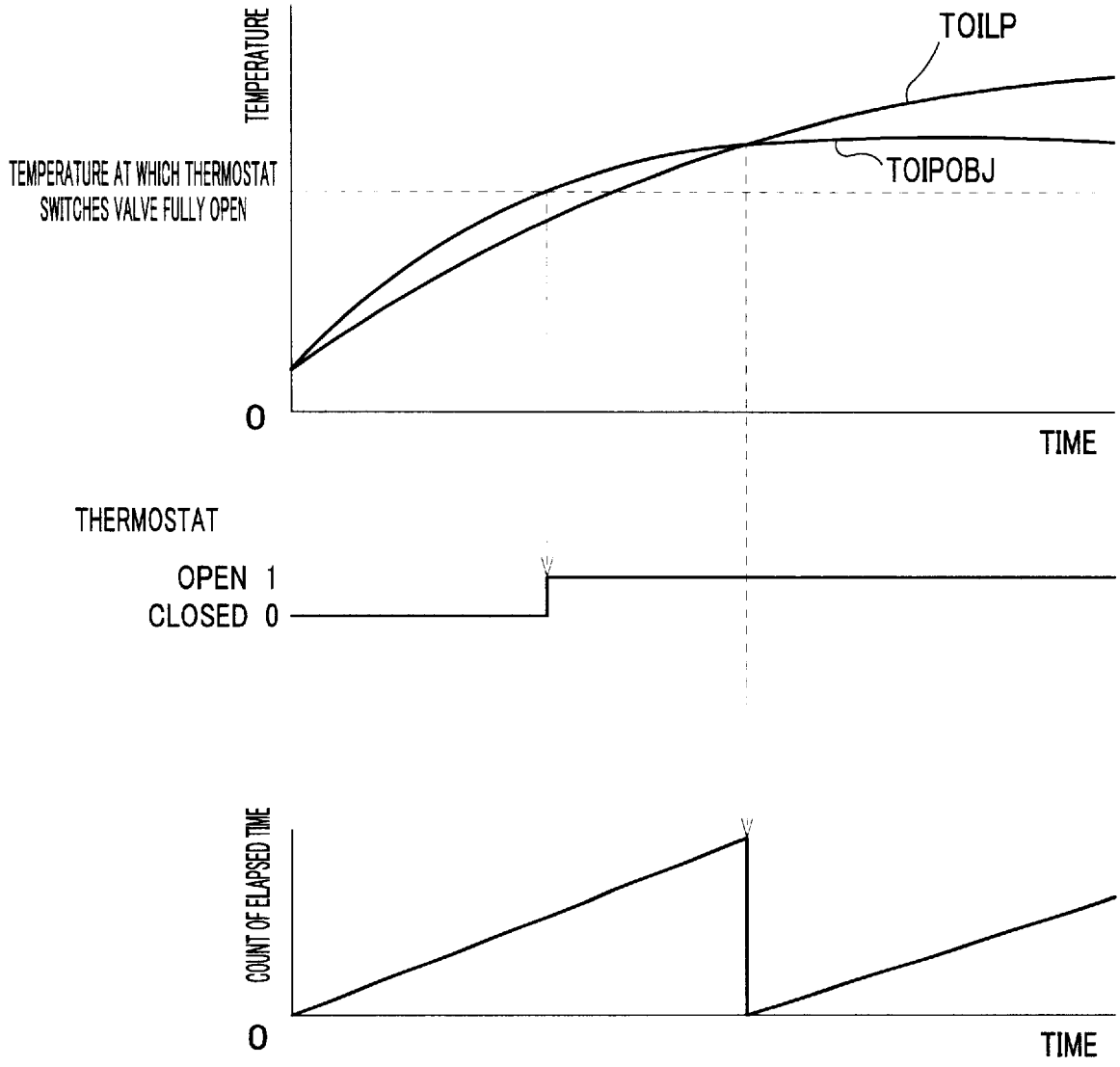
FIG. 9 is a graph showing a relationship between estimated oil temperatures and target oil temperatures, and a correlated timing chart showing OPEN/CLOSED states of a thermostatic switch, and counts of elapsed time.

If it is determined in step S91 that the engine is not in the startup mode, it is determined whether an estimated oil temperature curve and a target oil temperature curve have intersected (S93). A description will be given herein of a relation ship between the estimated oil temperature and the target oil temperature with reference to FIG. 9. FIG. 9 shows the OPEN/CLOSED states of the thermostat 16 and the counts of the elapsed time in addition to the relationship between the estimated oil temperature TOILP and the target oil temperature TOILPOBJ.

The target oil temperature TOILPOBJ increases steadily until a certain period of time elapses, but the increase slows with time, as shown in the graph in FIG. 9. This is because the target oil temperature TOILPOBJ changes according to water temperature, which is held down under the action of the thermostat 16 that opens the valve. In contrast, the estimated oil temperature TOILP does not increase so rapidly as the target oil temperature TOILPOBJ from the initial state until a certain period of time elapses, but keeps on increasing even when the target oil temperature TOILPOBJ has almost come to stop increasing. This is because the oil temperature is under the great influence of a temperature in the engine, and increases with heat produced in the engine. Accordingly, the target oil temperature TOILPOBJ is higher than the estimated oil temperature TOILP from the initial state until a certain period of time elapses, but the situation is reversed at a certain point of time, and the estimated oil temperature TOILP becomes higher than the target oil temperature TOILPOBJ. Thus, the reversed relationship between the estimated oil temperature TOILP and the target oil temperature TOILPOBJ changes the tendency of increase of each temperature; therefore, the elapsed time is reset at this moment (S92).

If it is determined that the estimated oil temperature curve and the target oil temperature curve have not intersected, it is determined whether the count of the timer has reached underlying elapsed time (S94). This process is carried out for the purpose of adding corrected count to elapsed time CTTOILP that will be described later every time when the count reaches the underlying elapsed time TMTOILPB. If it is determined that the count of the timer has not reached the underlying elapsed time, the process goes to step S102 that will be described later. If it is determined that the count of the timer has reached the underlying elapsed time, the OPEN/CLOSED state of the thermostat 16 is determined (S95). The determination of the OPEN/CLOSED state of the thermostat 16 is made using the result obtained in step S22 shown in FIG. 4. If it is resultantly determined that thermostat 16 is in the OPEN state, the underlying elapsed time TMTOILPB is simply added to the elapsed time CTTOILP (S96). When the thermostat 16 is in the OPEN state, the oil temperature and water temperature are kept higher. Among factors that could conceivably affect the oil temperature other than the water temperature are heat generated by rotary action of the engine, and an outside air temperature. When both of the oil temperature and water temperature are lower, the other factors as above have enormous influence; however, when the oil temperature and water temperature are higher, the water temperature exercises much greater influence on the oil temperature in comparison with the other factors. In view of these circumstances, when the oil temperature and water temperature are higher with the thermostat 16 in the OPEN state, the other factors such as the rotary action of the engine and the outside air temperature are excluded, and the underlying elapsed time TMTOILPB is simply added to the elapsed time CTTOILP.

If it is determined that the thermostat 16 is in the CLOSED state, the number of revolutions of the engine NE is worked out based upon a crank angle detected by the fuel injection TDC sensor 24 and the crank angle sensor 25. Based upon the number of revolutions of the engine NE, a first elapsed time correction coefficient KCTOILPNE for correcting the underlying elapsed time TMTOILPB is retrieved from a first elapsed time correction coefficient table (S97). The first elapsed time correction coefficient table indicates the first elapsed time correction coefficients KCTOILPNE corresponding to the numbers of revolutions of the engine NE; the larger the number of revolutions of the engine NE, the larger the first elapsed time correction coefficient KCTOILPNE becomes.

When the first elapsed time correction coefficient KCTOILPNE is located, a second elapsed time correction coefficient KCOILPTA for correcting the underlying elapsed time TMTOILPB is retrieved from a second elapsed time correction coefficient table based upon an outside air temperature TA detected by the outside-air temperature sensor 22 (S98). The second elapsed time correction coefficient table indicates the second elapsed time correction coefficients KCOILPTA corresponding to the outside air temperatures TA; the higher the outside air temperature TA, the larger the second elapsed time correction coefficient KCOILPTA becomes.

When the first elapsed time correction coefficient KCTOILPNE and second elapsed time correction coefficient KCOILPTA are located as described above, the underlying elapsed time TMTOILPB is multiplied by the first elapsed time correction coefficient KCTOILPNE and second elapsed time correction coefficient KCOILPTA, and added to a preceding value of the elapsed time $CTTOILP_{n-1}$, as shown in the following equation (S99):

$$CTTOILP=CTTOILP_{n-1}+TMTOILPB\times KCTOILPNE\times KCOILPTA \quad (4)$$

where CTTOILP denotes the elapsed time; $CTTOILP_{n-1}$ denotes the preceding elapsed time; TMTOILPB denotes the underlying elapsed time; KCTOILPNE denotes the first elapsed time correction coefficient; and KCOILPTA denotes the second elapsed time correction coefficient.

When the new elapsed time CTTOILP is worked out in such a manner as described above, the timer is reset (S100), and an estimated oil temperature correction coefficient KTOILP is located from the elapsed time CTTOILP by looking up an estimated oil temperature correction coefficient table (S101). The estimated oil temperature correction coefficient table indicates the estimated oil temperature correction coefficients KTOILP corresponding to counts of the elapsed time CTTOILP; the longer the elapsed time CTTOILP, the larger the estimated oil temperature correction coefficient KTOILP becomes.

Then, the estimated oil temperature TOILP is worked out according to the equation (5):

$$TOILP=TOILPST+(TOILPOBJ-TOILPST)\times KTOILP \quad (5)$$

where TOILP denotes the estimated oil temperature; TOILPST denotes the initial oil temperature; TOILPOBJ denotes the target oil temperature; and KTOILP denotes the estimated oil temperature correction coefficient.

Thus, the process for working out the estimated oil temperature is completed (S103).

The resultant estimated oil temperature TOILP is used in step S10 in the flowchart shown in FIG. 3 to determine oil degradation.

Although the preferred embodiment of the present invention has been described above, the present invention is not limited to this embodiment. For example, although the number of revolutions of the crank is used to work out the use level of the engine oil in the present embodiment, but a distance traveled may be used, instead of the number of revolutions of the crank, as the use level of the engine oil. Similarly, the alarm 18 is provided in the present embodiment, but an alternative embodiment may be exercised in which a driving mode of the engine body is automatically switched, when it is determined that the engine oil has degraded, to a saving mode that permits the engine to be driven at the lowest rpm so as not to develop degradation of the oil.

As described above, according to one aspect of the present invention as set forth in claim 1, degradation of the oil may be determined without an engine oil temperature sensor for detecting an engine oil temperature, and thus the number of parts may be reduced. Further, the change in temperature of the cooling water and the engine oil is largely dependent upon the open/closed state of a control valve, and thus the temperature of the engine oil may be accurately estimated based upon the open/closed state of the control valve.

According to another aspect of the present invention as set forth in claim 2, correction is made to a lapse of time based upon a driving manner is made using the open/closed state of the control valve. Therefore, the difference in tendency of the oil temperature increase may accurately be reflected on the estimate.

According to another aspect of the present invention as set forth in claim 3, the water temperature is corrected according to a driving manner of the internal combustion engine when the control valve is open; therefore, the difference in tendency of the temperature increase between oil and water may be corrected, so that the oil temperature may accurately be estimated.

According to another aspect of the present invention as set forth in claim 4, the temperature of engine oil may accurately be estimated irrespective of the conditions of the internal combustion engine upon startup.

What is claimed is:

1. An engine oil degradation detector that works out a use level of an engine oil in accordance with a driving manner of the internal combustion engine, the use level of the engine oil indicating how much the engine oil in an internal combustion engine has been used, wherein the engine oil degradation detector includes an engine oil temperature estimation means that estimates a temperature of the engine oil, the use level of the engine oil being corrected with an engine oil degradation coefficient obtained according to the temperature of the engine oil estimated by the engine oil temperature estimation means;

wherein the engine oil degradation detector integrates the corrected use levels of the engine oil, and determines that a time to change the engine oil has come when the integrated use level reaches a predetermined value indicating a usable life of the engine oil; and wherein the engine oil estimation means works out an estimated engine oil temperature based upon a cooling water temperature of cooling water that cools the internal combustion engine, and an open/closed state of a control valve provided in a cooling water channel.

2. An engine oil degradation detector according to claim 1, wherein the engine oil temperature estimation means works out the estimated engine oil temperature in accordance with elapsed time of driving of the internal combustion engine, and wherein the elapsed time is corrected in accordance with a driving manner of the internal combustion engine when the control valve is closed.

3. An engine oil degradation detector according to claim 1, wherein the engine oil temperature estimation means corrects the cooling water temperature in accordance with a driving manner of the internal combustion engine, and works out the estimated engine oil temperature based upon the corrected cooling water temperature.

4. An engine oil degradation detector according to claim 1, wherein the engine oil temperature estimation means works out an initial value of the estimated engine oil temperature in accordance with a soaking state of the internal combustion engine.

* * * * *